US007386254B2

(12) United States Patent
Okoshi

(10) Patent No.: US 7,386,254 B2
(45) Date of Patent: Jun. 10, 2008

(54) POSITION ADJUSTING MECHANISM, PROCESS CARTRIDGE PROVIDED THEREWITH, AND IMAGE FORMING APPARATUS PROVIDED THEREWITH

(75) Inventor: Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 10 days.

(21) Appl. No.: 11/390,188

(22) Filed: Mar. 28, 2006

(65) Prior Publication Data

US 2007/0020017 A1 Jan. 25, 2007

(30) Foreign Application Priority Data

Jul. 25, 2005 (JP) ..... 2005-215022

(51) Int. Cl.
*G03G 21/16* (2006.01)
*G03G 15/00* (2006.01)

(52) U.S. Cl. ..... 399/113; 399/111

(58) Field of Classification Search ..... 399/113, 399/111, 112, 124, 125, 126
See application file for complete search history.

(56) References Cited

U.S. PATENT DOCUMENTS 5,552,857 A * 9/1996 Ishikawa ..... 399/113
5,737,668 A * 4/1998 Johroku ..... 399/120
6,163,666 A * 12/2000 Hosokawa et al. ..... 399/111
6,751,428 B2 * 6/2004 Okabe ..... 399/111
7,184,688 B2 * 2/2007 Ishii ..... 399/113
2004/0184834 A1 * 9/2004 Blaine et al. ..... 399/113

FOREIGN PATENT DOCUMENTS

JP 10-187005 A 7/1998
KR 1994-0006005 A 3/1994
KR 1994-0006007 A 3/1994
KR 1994-0007627 A 4/1994

* cited by examiner

*Primary Examiner*—Sophia S Chen
(74) *Attorney, Agent, or Firm*—Sughrue Mion, PLLC

(57) ABSTRACT

A position adjusting mechanism, straddling a holding section for rotatably holding rollers and an opposed holding section for holding an opposed member disposed opposite to the rollers, wherein mutual positions between the holding section and the opposed holding section are adjusted, whereby mutual positions between the rollers and the opposed member are adjusted, the position adjusting mechanism including: a revolution sustainment structure provided at an end on one side in the longitudinal direction of the rollers and rotatably sustaining the opposed holding section with respect to the holding section; and a slide sustainment structure sustained at another end on the other side in the longitudinal direction of the rollers at two or more positions and sustaining the opposed holding section with respect to the holding section in a slidable manner.

16 Claims, 13 Drawing Sheets

POSITION ADJUSTING MECHANISM, PROCESS CARTRIDGE PROVIDED THEREWITH, AND IMAGE FORMING APPARATUS PROVIDED THEREWITH

CROSS REFERENCE TO RELATED APPLICATION

This application claims priority under 35 USC 119 from Japanese Patent Application No. 2005-215022, the disclosure of which is incorporated by reference herein.

BACKGROUND OF THE INVENTION

1. Field of the Invention

The present invention relates to a position adjusting mechanism for adjusting mutual positions of rollers and an opposed member which is opposed to the rollers, a process cartridge provided with the position adjusting mechanism, and an image forming apparatus provided with the process cartridge.

2. Description of the Related Art

A mechanism including a process unit described hereinbelow by which downsizing of the whole process unit and reduction in weight thereof can be realized is known. The process unit is for an image forming apparatus wherein a photoreceptor unit and a development unit are supported by supporting shafts in a swingable manner, and they are mounted detachably on a machine housing. An axis of a development roller provided on the development unit is inclined towards an inverse direction to that of flexure of the supporting shaft with respect to an axis of a photoreceptor drum provided on the photoreceptor unit in response to an amount of flexure of the supporting shaft derived from a driving torque acting on an input gear provided on the development unit from a drive gear provided on the machine housing, so that a degree of parallelization between the development roller and the photoreceptor drum is maintained at the time of image formation wherein the driving torque is transmitted to the input gear from the drive gear. As described above, a degree of parallelization between the development roller and the photoreceptor drum can be maintained without increasing rigidity of the supporting shaft. As a result, there is no need to use a supporting shaft having a large diameter in order to maintain rigidity, whereby downsizing and decrease in weight of the whole process unit can be realized (see Japanese Patent Application Laid-Open No. 10-187005).

In a conventional mechanism, however, there is a problem in that it is difficult to stably maintain deviance between a development roller and a photoreceptor drum within a predetermined range with respect to dispersion of a driving torque. In addition, there is also a problem in that a conventional mechanism cannot cope with demands for increase in a volume of a toner containment part and simplification of a holding section with respect to a process cartridge provided in an image forming apparatus.

SUMMARY OF THE INVENTION

The invention has been made in view of the above circumstances, and provides a position adjusting mechanism by which deviance between rollers and an opposed member which is opposed to the rollers can be maintained within a predetermined range with a simple construction; a process cartridge provided with the position adjusting mechanism; and an image forming apparatus provided with the process cartridge.

The present inventor focused attention on the fact that when structures for sustaining a pair of opposed rollers are arranged such that both of opposite ends of the rollers in the longitudinal direction thereof are made to be revolution sustainment structures, excessive force acts when adjusting a space, whereby poor accuracy occurs easily. Then, as a result of earnest study, it was conceived of to provide an arrangement in which one of the structures is not a revolution sustainment structure, but rather another sustaunment structure. Further studies are continued by the inventor to complete the invention.

A first aspect of the invention provides a position adjusting mechanism, straddling a holding section for rotatably holding rollers and an opposed holding section for holding an opposed member disposed opposite to the rollers, wherein mutual positions between the holding section and the opposed holding section are adjusted, whereby mutual positions between the rollers and the opposed member are adjusted, the position adjusting mechanism including: a revolution sustainment structure provided at an end on one side in the longitudinal direction of the rollers and rotatably sustaining the opposed holding section with respect to the holding section; and a slide sustainment structure sustained at another end on the other side in the longitudinal direction of the rollers at two or more positions and sustaining the opposed holding section with respect to the holding section in a slidable manner.

In the first aspect of the invention, a revolution sustainment structure is disposed at an end on one side of rollers in the longitudinal direction thereof, while a slide sustainment structure is disposed at an end on the other side of the rollers in the longitudinal direction as described above. Accordingly, deviance (which is a concept including a space and a degree of parallelization) between the rollers and the opposed member which are mutually opposed can be maintained within a predetermined range. The predetermined range is decided in accordance with diameters of the rollers, required precision and the like.

Furthermore, the slide sustainment structure is sustained at two or more positions. Thus, even when force is applied from a driving force transmitting section such as a gear, bending occurring at the holding section and the opposed holding section is small, whereby deviance can be suppressed.

Moreover, the slide sustainment structure is disposed along a direction in which revolution derived from the revolution sustainment structure is not obstructed, and preferably it is disposed tangentially on a virtual locus defined by the revolution sustainment structure.

Further, sustainment at two or more positions does not include a slide sustainment structure composed of, for example, a long hole and one columnar boss, but rather means a structure wherein a sustainment part abuts a slide surface at at least two positions when force is received by the opposed holding section.

The position adjusting mechanism of the first aspect according to the invention may be a mechanism wherein the rollers are in contact with the opposed member, or the rollers are not in contact with the opposed member, and in addition, it may be a mechanism wherein the rollers move into contact with the opposed member and move away therefrom. In addition, although the position adjusting mechanism according to the first aspect of the invention is optimum for application to a process cartridge constituting an image forming apparatus, it is applicable to a member other than the process cartridge as a matter of course.

BRIEF DESCRIPTION OF THE DRAWINGS

Preferred embodiments of the invention will be explained in detail based on the following figures, wherein.

DETAILED DESCRIPTION OF THE INVENTION

Figure 1:
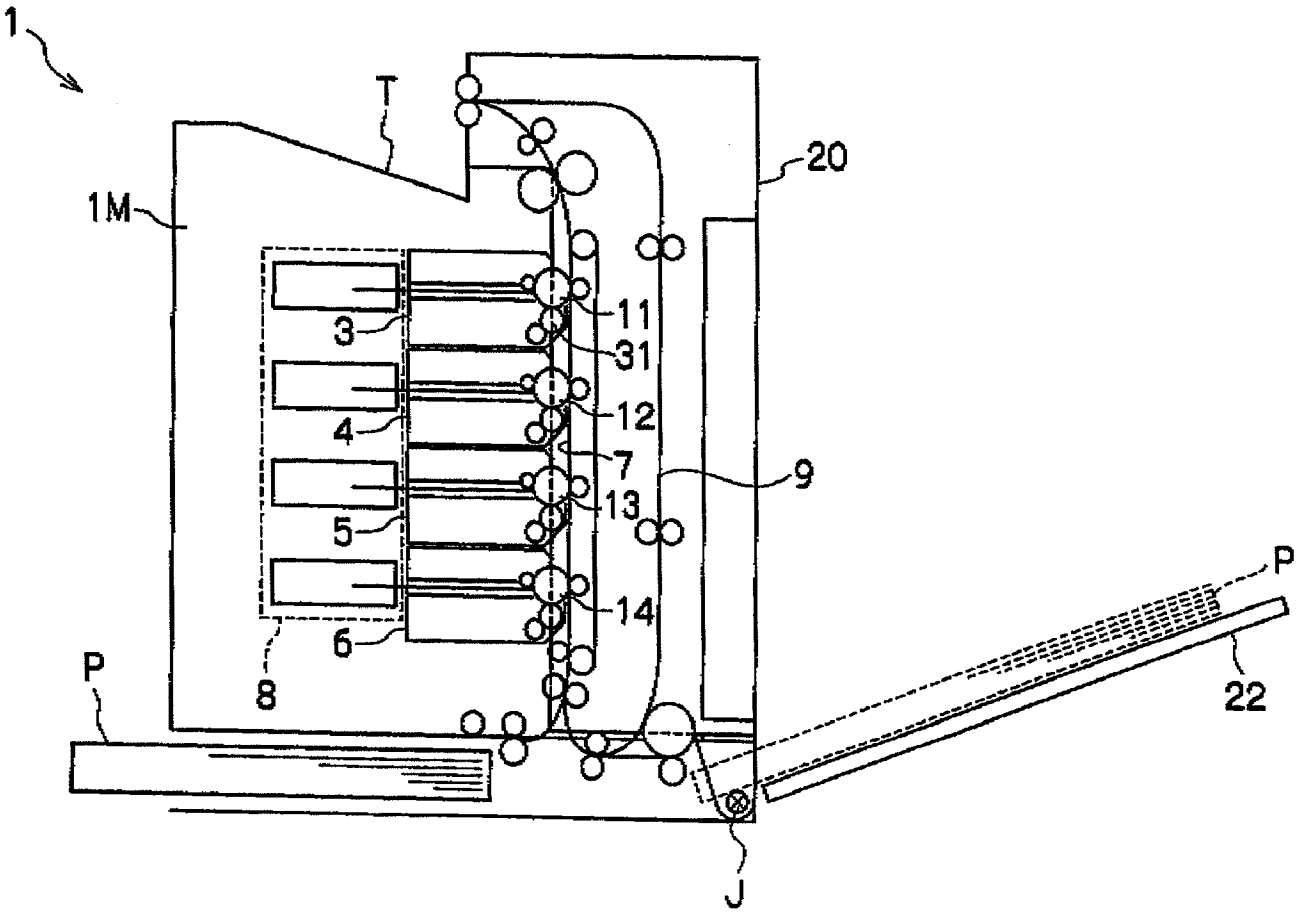
FIG. 1 is a side sectional view showing a constitution of a printer according to an embodiment of the invention (wherein a manual tray is in an opened state)
Figure 2:
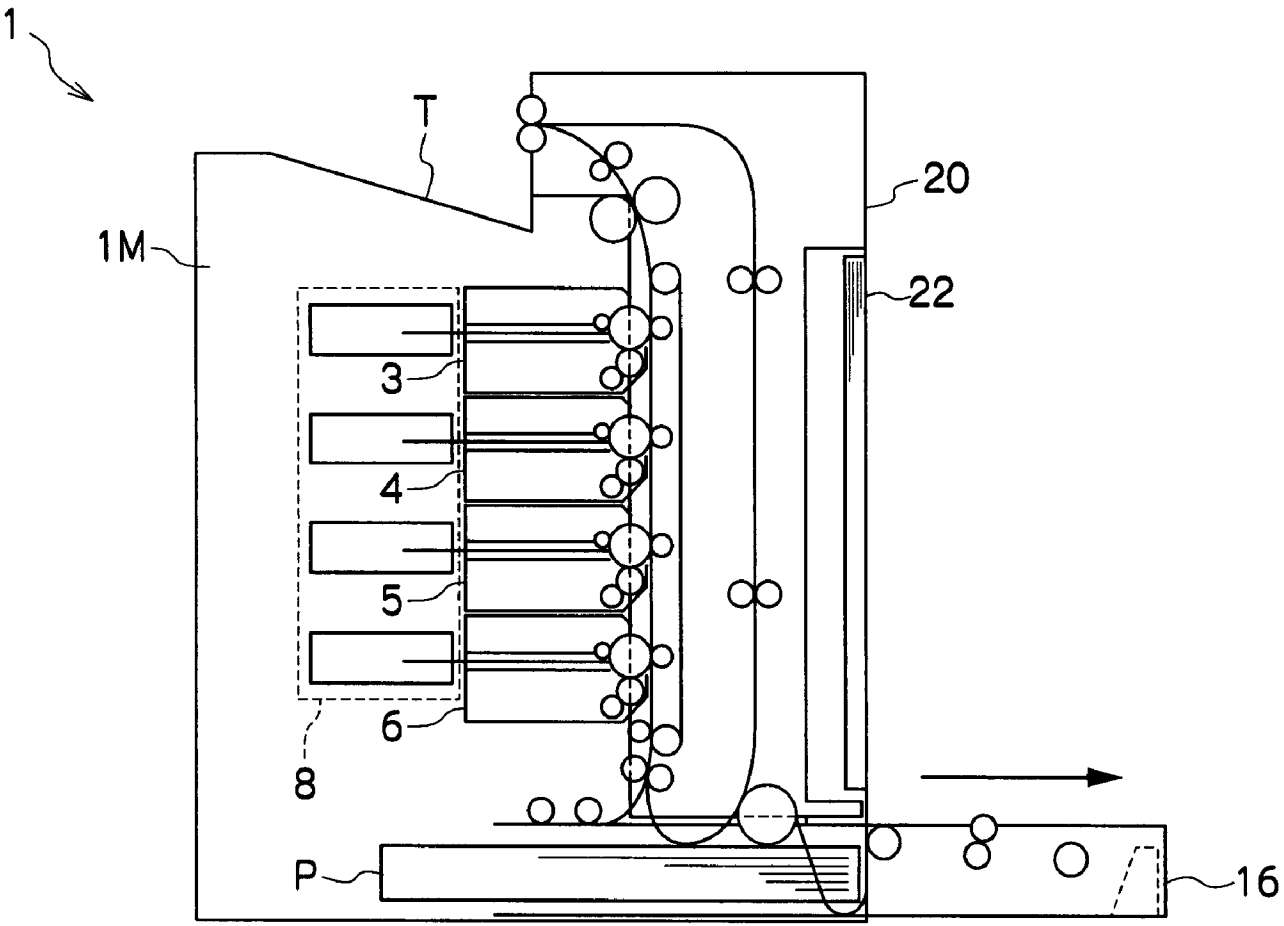
FIG. 2 is a side sectional view showing the constitution of the printer according to the embodiment of the invention (wherein a paper feed cassette is in a drawn out state without the manual tray being opened)
Figure 3:
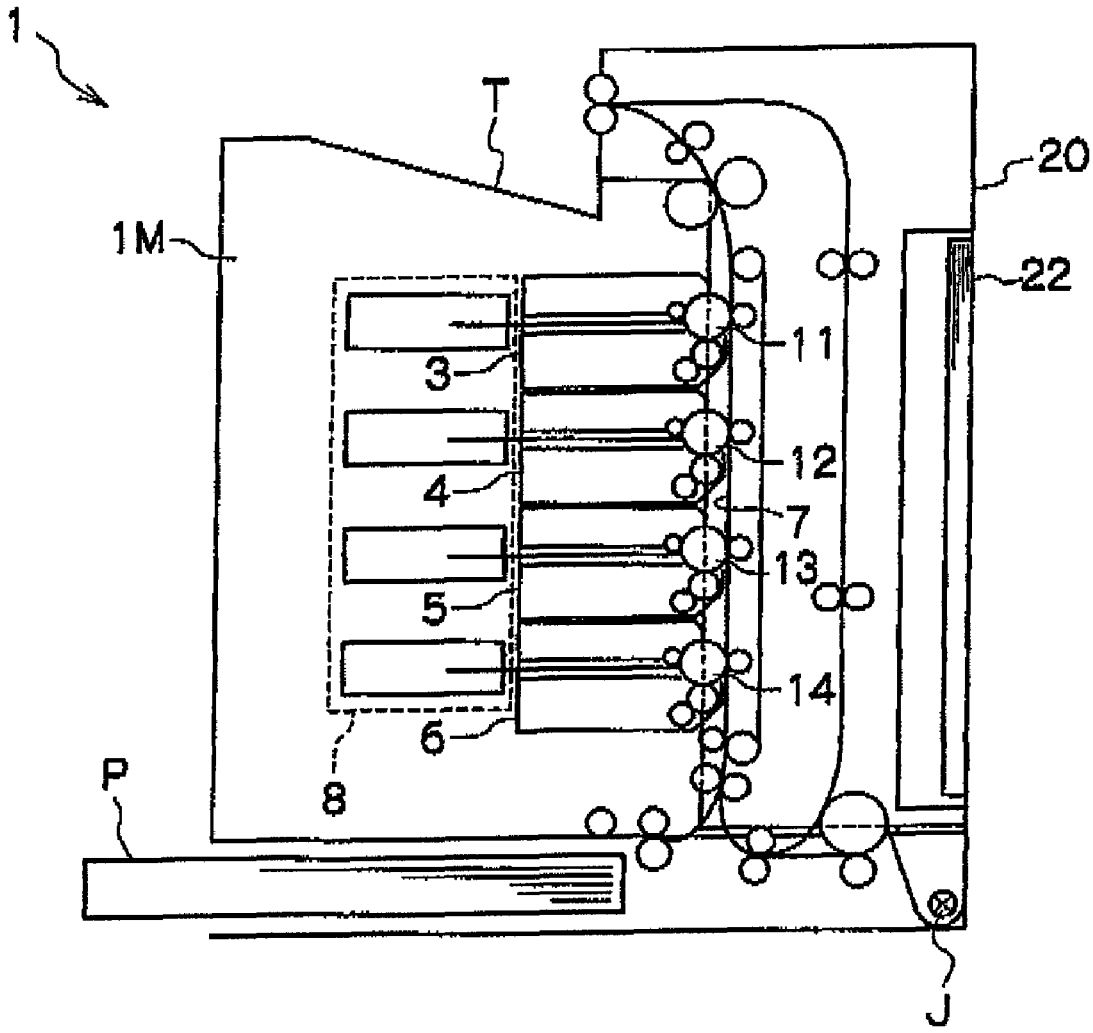
FIG. 3 is a side sectional view showing the constitution of the printer according to the embodiment of the invention (wherein the manual tray is closed, and the paper feed cassette is put in)
Figure 4:
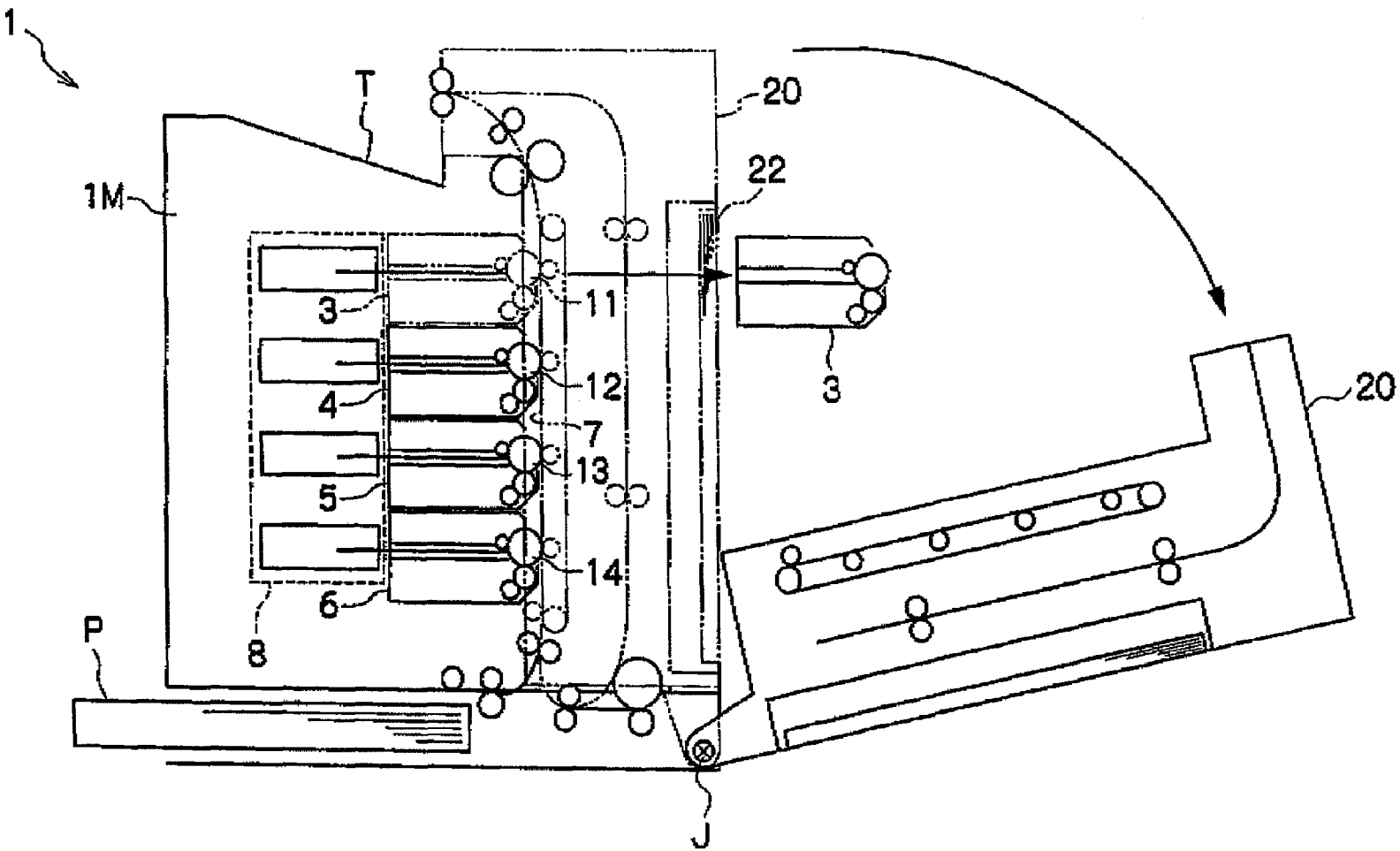
FIG. 4 is a side sectional view showing the constitution of the printer according to an embodiment of the invention (wherein an opening/closing part is in an opened state)
Figure 5:
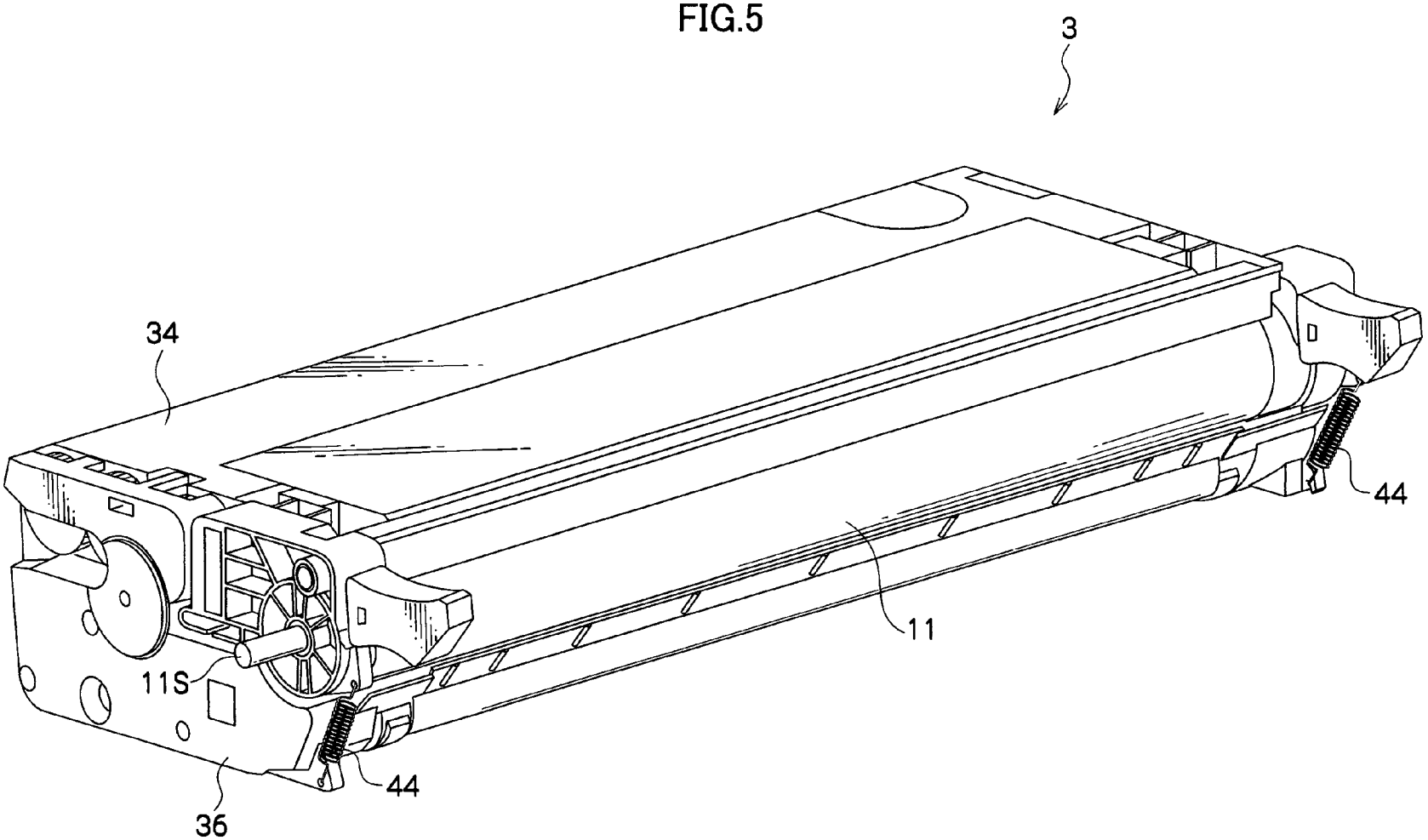
FIG. 5 is a perspective view showing a process cartridge which is provided in the printer according to an embodiment of the invention.
Figure 6:
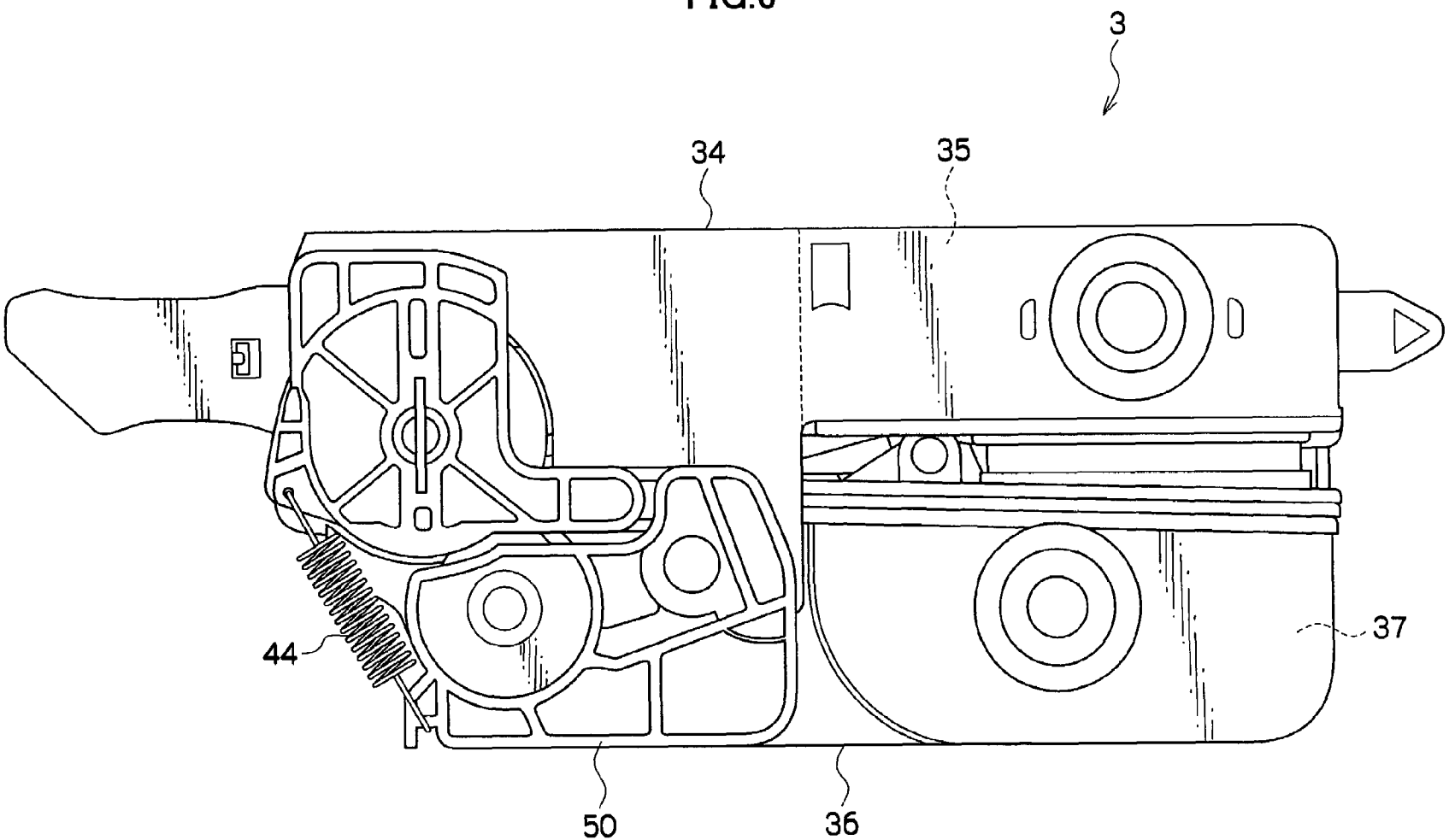
FIG. 6 is a side view showing the process cartridge which is provided in the printer according to an embodiment of the invention.
Figure 7:
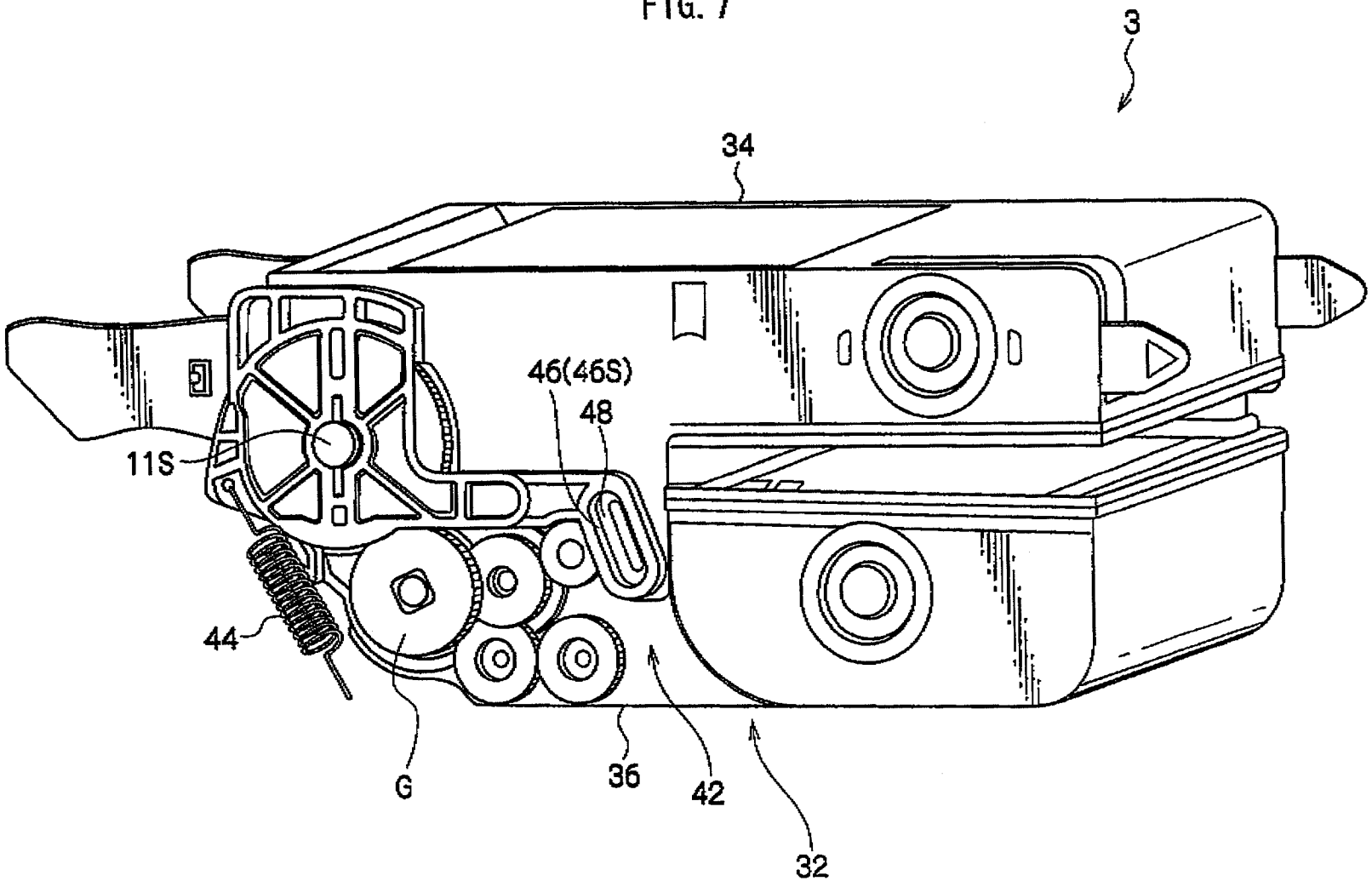
FIG. 7 is a perspective view showing the process cartridge which is provided in the printer according to an embodiment of the invention.

Below, an embodiment of the invention is described. As shown in FIGS. 1 and 2, a printer 1 according to an embodiment of the invention is a full-color printer. Inside a printer main body 1M of the printer 1, four process cartridges 3, 4, 5, and 6 are arranged substantially vertically, and a transfer belt 7 provided along these process cartridges 3, 4, 5, and 6, wherein the process cartridges 3, 4, 5, and 6 may be detached in a substantially horizontal direction from a space produced by releasing the transfer belt 7. The process cartridges 3, 4, 5, and 6 have photoreceptor drums (image holding bodies) 11, 12, 13, and 14, respectively.

Furthermore, the printer 1 includes a ROS 8 for exposing each of the photoreceptor drums 11, 12, 13, and 14, and electrostatic latent images formed on the photoreceptor drums 11, 12, 13, and 14 are developed with respective color toners of black (K), cyan (C), magenta (M), and yellow (Y) in the process cartridges 3, 4, 5, and 6, respectively. The ROS 8 as an exposing device is composed of four semiconductor lasers which are lit and driven based on image data corresponding to the respective colors of yellow (Y), magenta (M), black (K), and cyan (C), an fθ lens, a polygon mirror, or a plurality of reflecting mirrors for deflection-scanning four laser beams output from the four semiconductor lasers, and the like.

Moreover, the printer 1 includes a paper feed cassette 16 for feeding transfer papers P as a transfer material (see FIG. 2) under these process cartridges. A cassette containment section by which the paper feed cassette 16 can be drawn is formed in the printer main body 1M.

The printer 1 further includes an opening/closing part 20 in the form of a cover constituting a side wall part on the side where the paper feed cassette 16 is drawn (a front side in FIGS. 1 to 4) at a position over the paper feed cassette 16. The opening/closing part 20 is adapted such that a side of the printer may be opened and closed with centering at a revolving fulcrum J disposed under the cassette containment section. Due to the constitution, when the opening/closing part is opened to expose the photoreceptor drums 11, 12, 13, and 14, maintenance can be performed to a jam or the like. The opening/closing part 20 includes an openable and closable manual tray 22, whereby desired transfer papers P can be fed through the manual tray 22 from the outside of the printer main body 1M.

Other than those described above, the printer 1 includes a fixing device for fixing a toner image transferred onto a transfer paper P, a conveying path 9 for conveying the transfer paper P again for double face printing in a front-back reversed state wherein the image has been fixed on one surface of the transfer paper P by means of the fixation means, a control circuit for controlling operations of the printer, a controller composed of an image processing circuit or the like for image-processing image signals, and an electric circuit composed of a high-voltage power supply circuit or the like. In FIGS. 1 to 4, reference character T designates a discharge tray for discharging the transfer paper P on which the image is formed, and the discharge tray T is integrally provided on the upper part of the printer main body 1M.

(Process Cartridge)

Below, a process cartridge will be described. Since the four process cartridges 3, 4, 5, and 6 have the same constitutions, a detailed description will only be made for process cartridge 3, and explanations for the other process cartridges 4, 5, and 6 will be omitted.

As shown in FIGS. 5 to 13, the process cartridge 3 includes the photoreceptor drum 11, a development roller 31 which is disposed in the same direction as that of the photoreceptor drum 11 and pressed against the photoreceptor drum 11 (see FIG. 11), and a roller position adjusting mechanism 32 for adjusting mutual positions of the photoreceptor drum 11 and the development roller 31.

The roller position adjusting mechanism 32 is disposed so as to straddle a holding section 34 for holding the photoreceptor drum 11 in a rotatable manner and an opposed holding section 36 for holding the development roller 31 in a rotatable manner which is biased against the holding section 34, whereby mutual positions of these holding sections are adjustable. A revolution sustainment structure 40 for sustaining the opposed holding section 36 in a rotatable state with respect to the holding section 34 is provided at an end on one side of the drum in the longitudinal direction thereof (see FIG. 9). Further, a slide sustainment structure 42 for sustaining the opposed holding section 36 in a slidable state with respect to the holding section 34 is disposed at an end on the other side of the drum in the longitudinal direction thereof (see FIG. 7).

The holding section 34 includes a toner recovering part 35 for recovering waste toner, while the opposed holding section 36 includes a toner containment part 37 for containing toner to be supplied.

On both sides of the process cartridge 3, extension coil springs 44 which respectively engage with the holding section 34 and the opposed holding section 36 are provided, whereby the opposed holding section 36 is biased toward the holding section 34.

Figure 8:
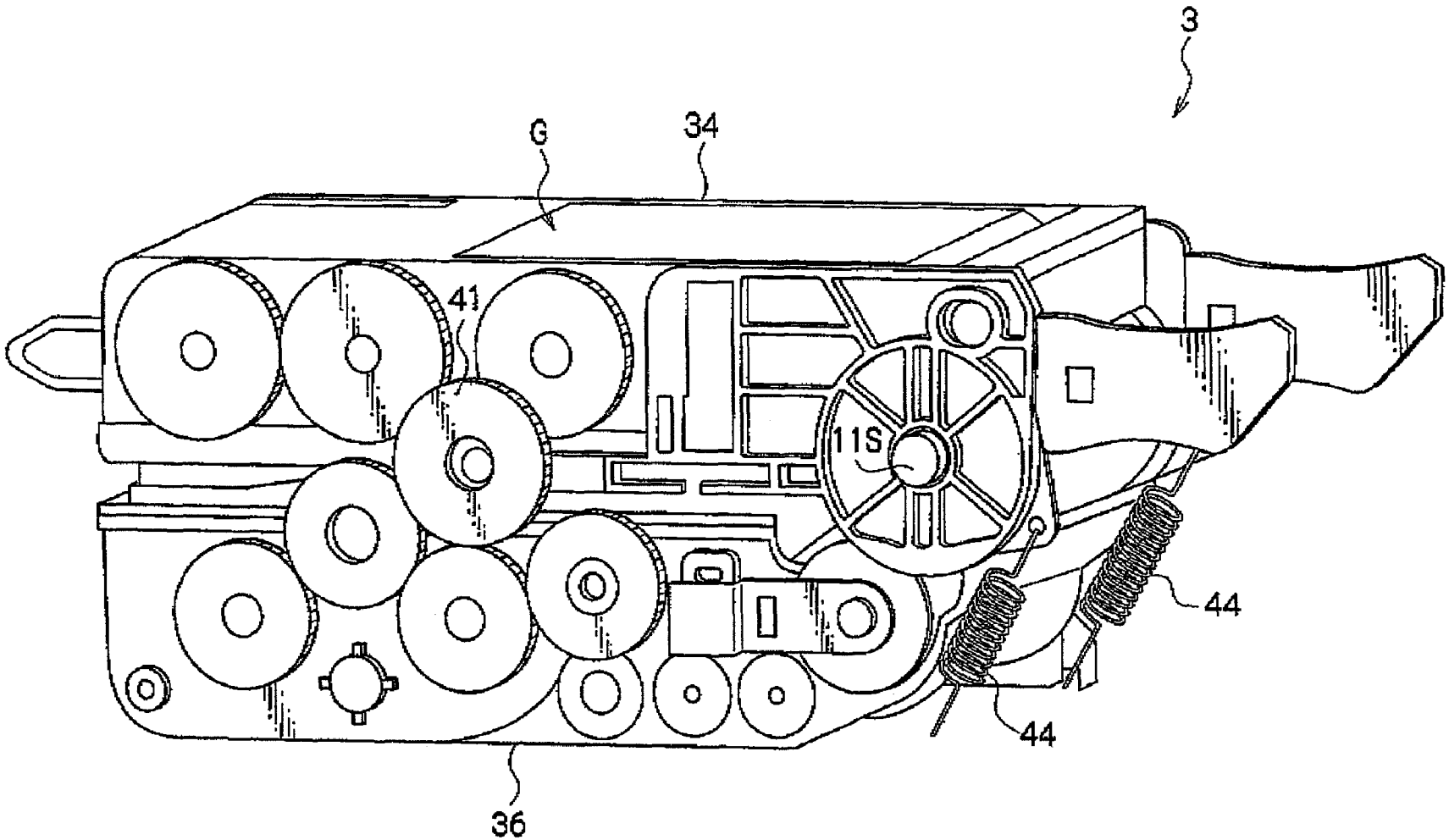
FIG. 8 is a perspective view showing a gear arrangement of the process cartridge which is provided in the printer according to an embodiment of the invention.
Figure 9:
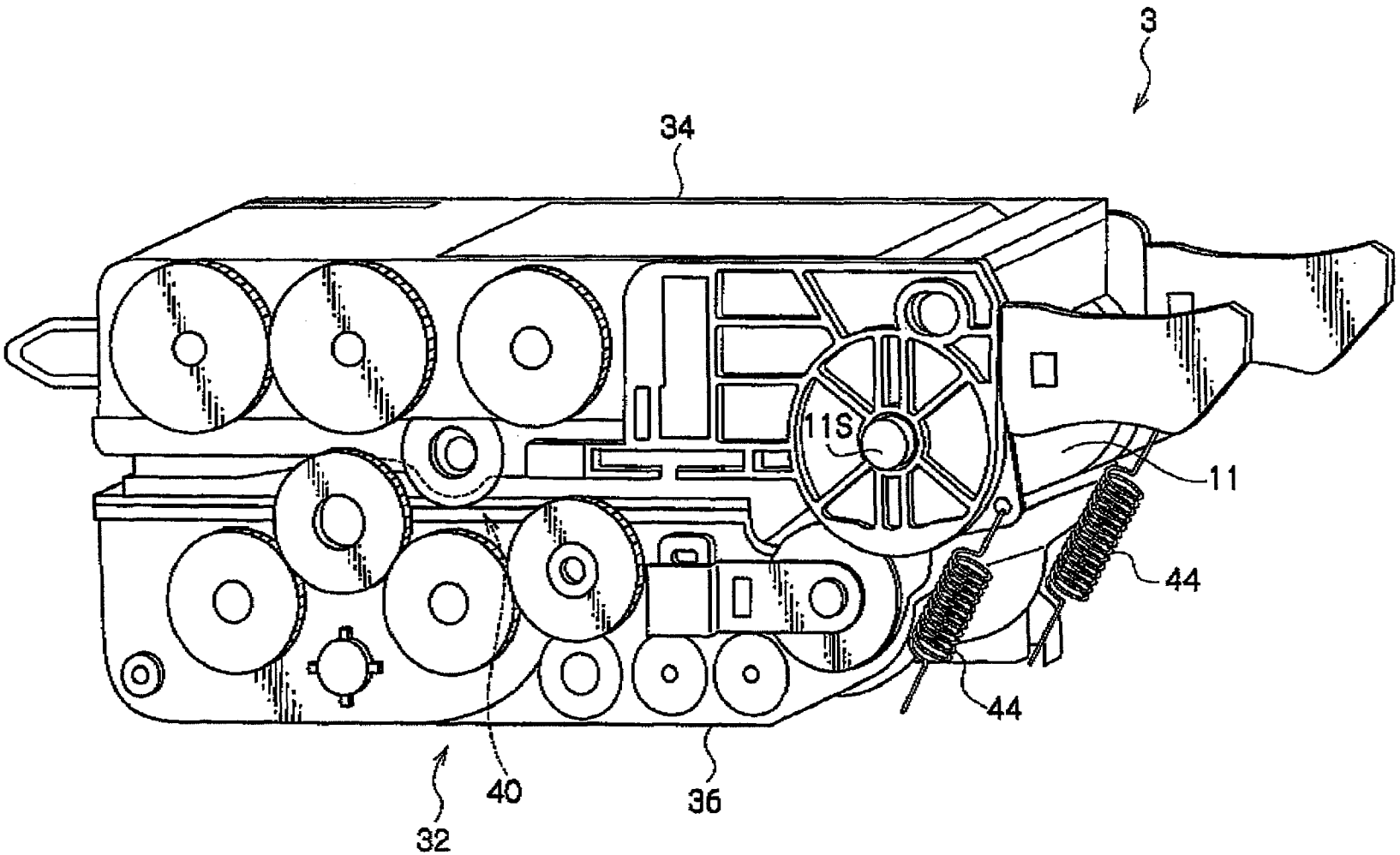
FIG. 9 is a perspective view showing the gear arrangement of a process cartridge which is provided in the printer according to an embodiment of the invention.
Figure 10:
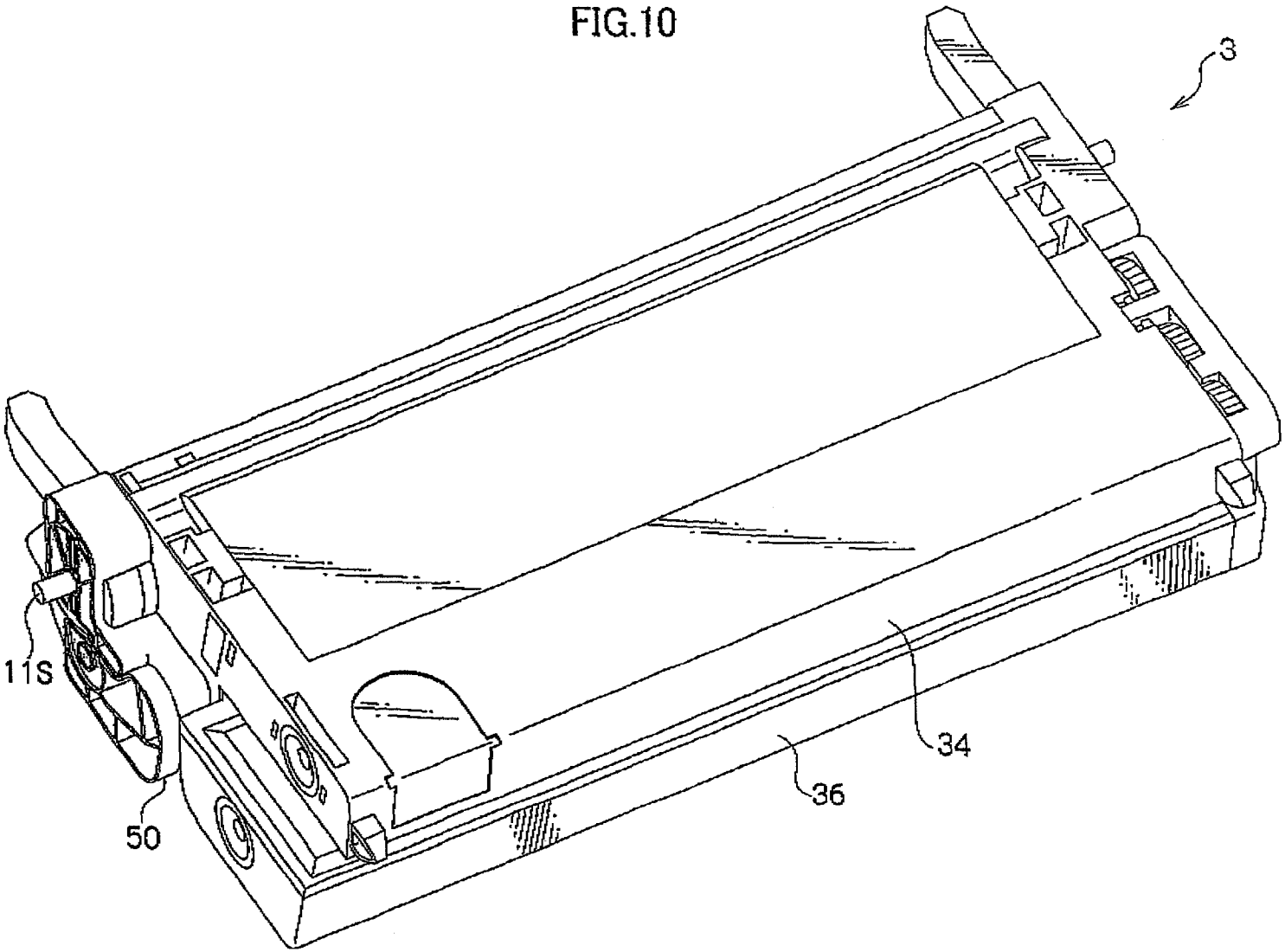
FIG. 10 is a perspective view showing the process cartridge which is provided in the printer according to an embodiment of the invention.
Figure 11:
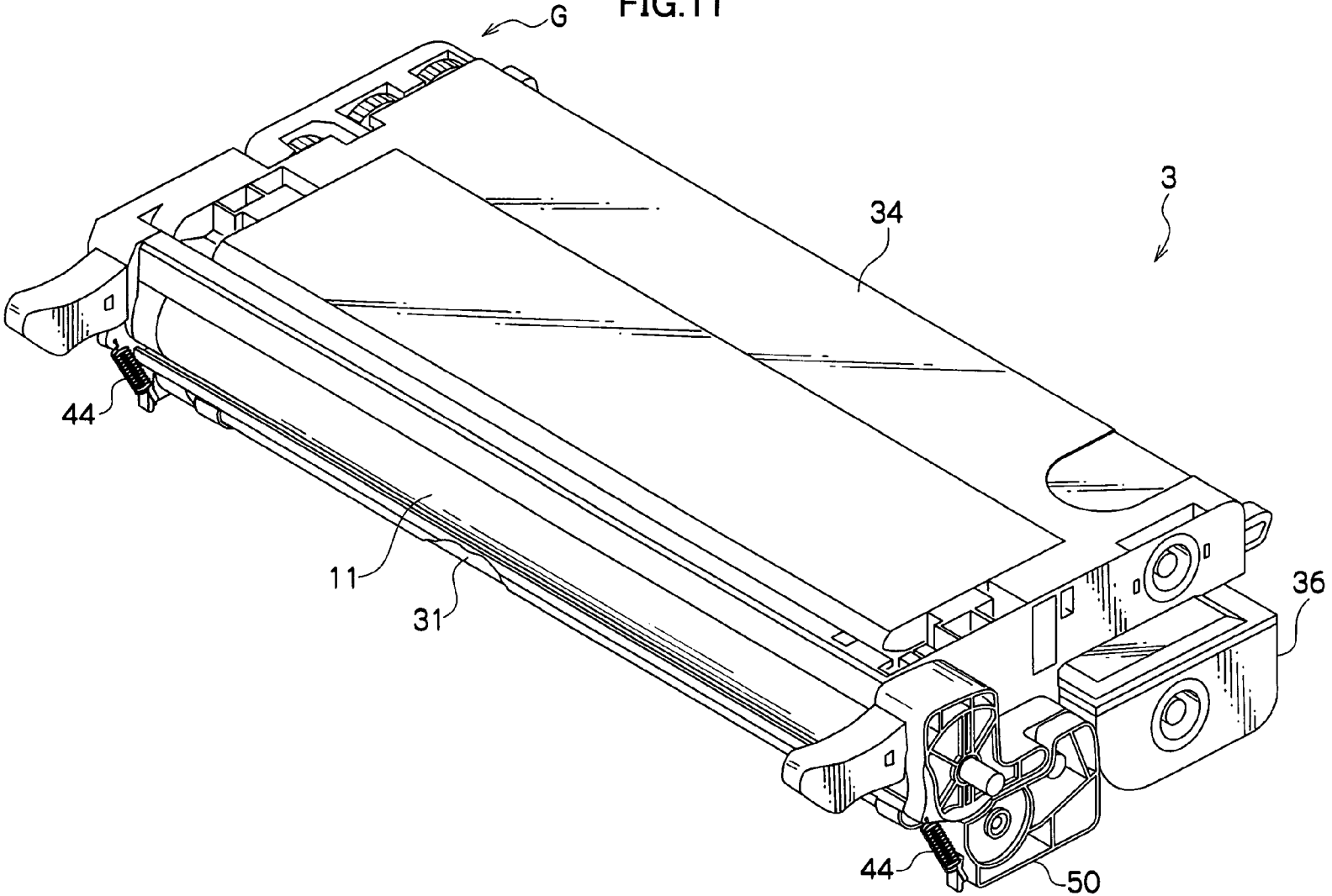
FIG. 11 is a perspective view (part of which is a perspective sectional view) showing the process cartridge which is provided in the printer according to an embodiment of the invention.

The revolution sustainment structure 40 is disposed on a rotation axis of an input gear 41 receiving drive force from the apparatus main body (see FIG. 8). As a result, driving force can be transmitted stably to both the holding section 34 and the opposed holding section 36. Thus, it is preferred that the holding section 34 and the opposed holding section 36 have the revolution sustainment structure, rather than the side sustainment structure, on at least the input gear side.

The slide sustainment structure 42 is a structure for slidably sustaining by being provided with a long hole 46 formed in the holding section 34, and a projection 48 to be inserted into the long hole 46 and provided on the opposed holding section 36. The longitudinal direction of the long hole 46 is not along a direction of force applied to the opposed holding section 36. Moreover, due to the projection 48 being formed into a long boss which abuts upon a guide surface 46S of the long hole 46 at two or more positions it can support at two or more positions even though there is only one of the long hole, so that it becomes possible to make the slide sustainment structure more simple, whereby this arrangement contributes to space saving. It is to be noted that the projection 48 may be provided, not on the opposed holding section 36, but rather on a cap 50 which will be mentioned later.

Figure 12:
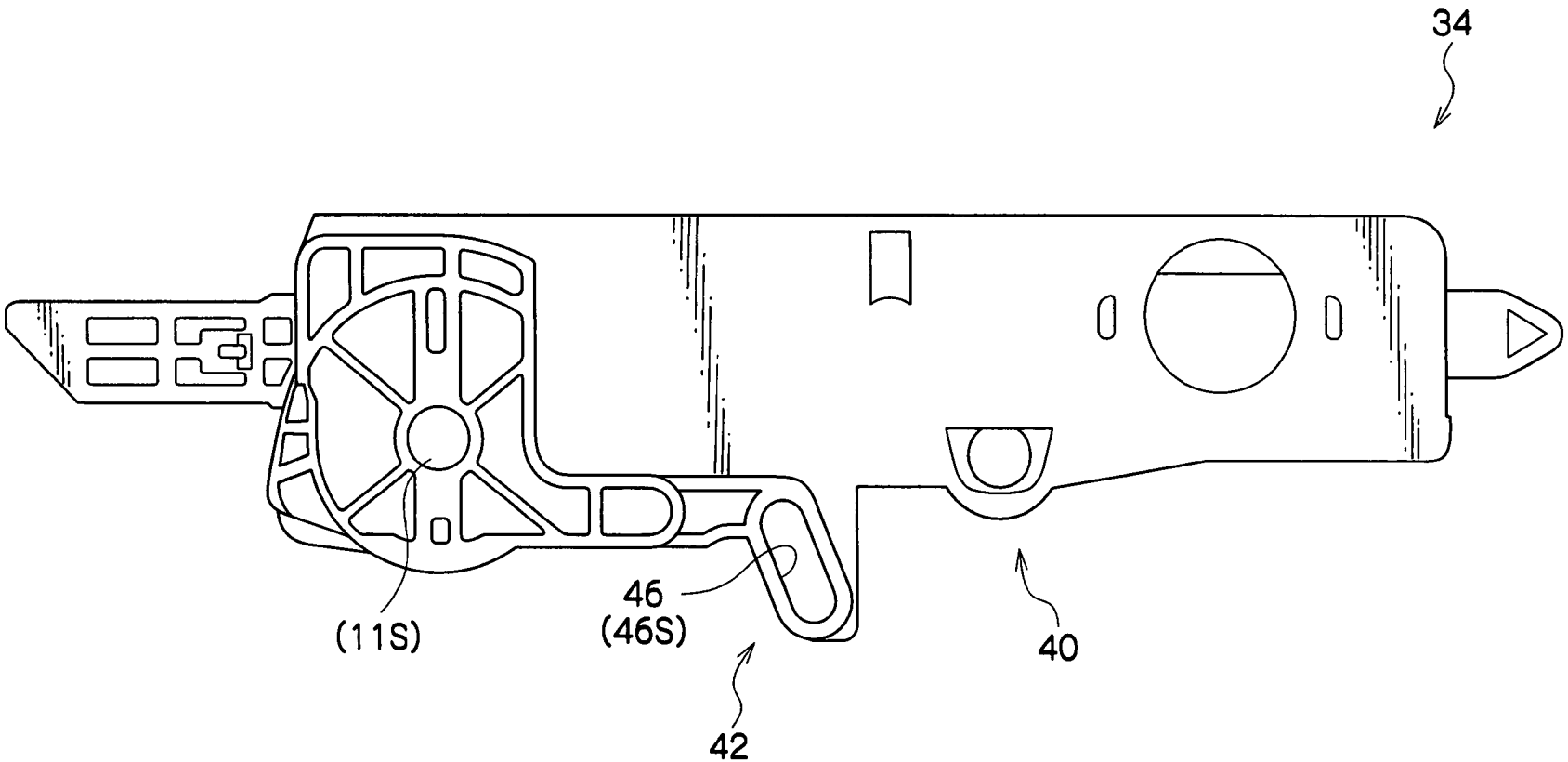
FIG. 12 is a side sectional view showing positions of a rotation axis of a photoreceptor drum, a long hole constituting a slide sustainment structure, and a circular hole constituting a revolution sustainment structure in the process cartridge which is provided in the printer according to an embodiment of the invention.
Figure 13:
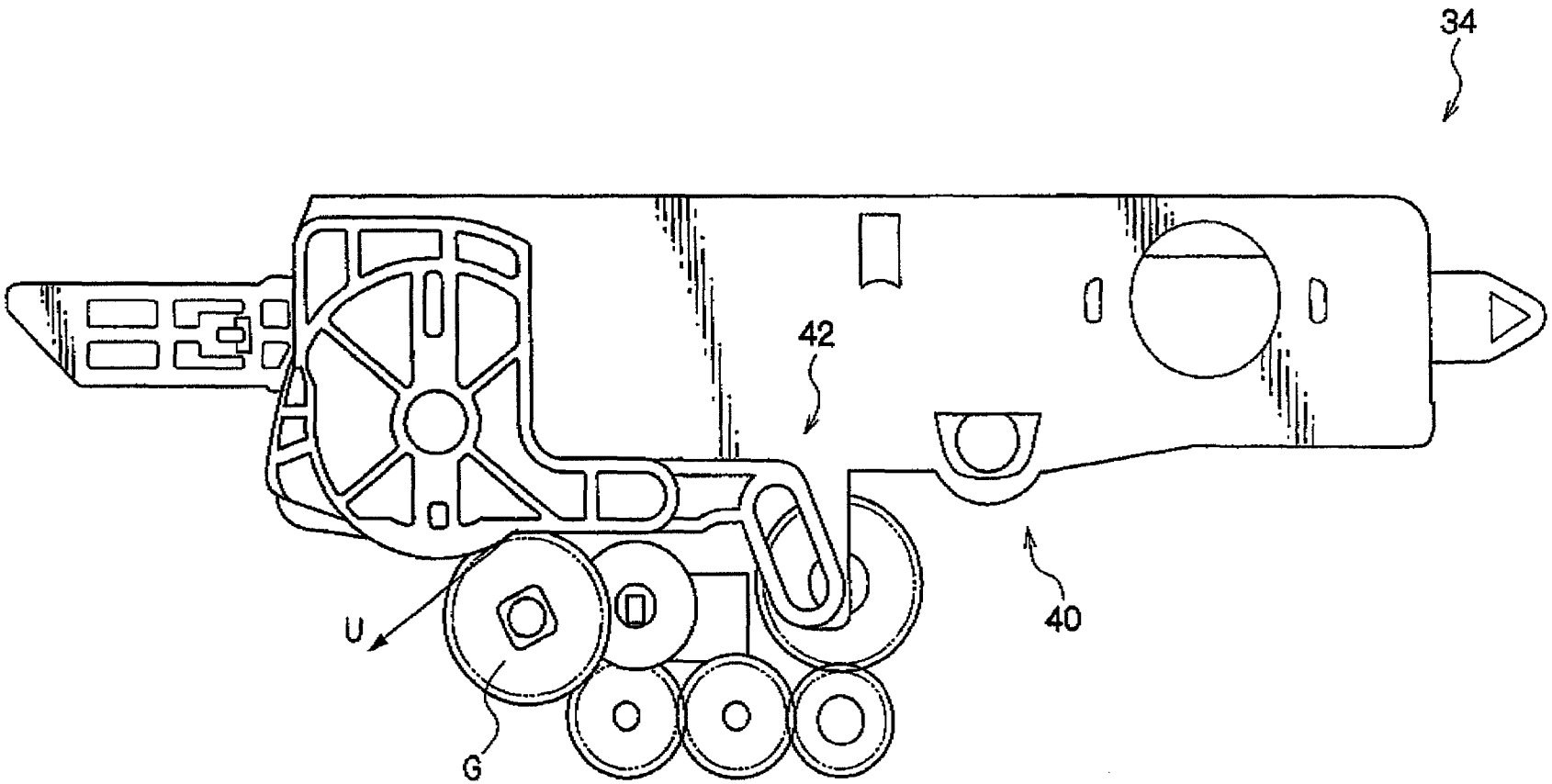
FIG. 13 is a side view showing the gear arrangement of the process cartridge which is provided in the printer according to an embodiment of the invention.

The slide sustainment structure 42 is positioned between the revolution sustainment structure 40 and the rotation axis 11S of the photoreceptor drum 11, when viewed from a direction of the rotation axis of the photoreceptor drum 11 (see FIG. 12).

A cap 50 is attached to the slide sustainment structure 42 so as not to disengage the holding section 34 with the opposed holding section 36 due to the revolution sustainment structure 40 and the slide sustainment structure 42.

As described above, the opposed holding section 36 is supported by the revolution sustainment structure 40 in a position-adjustable manner at an end on one side in the longitudinal direction of the drum, and the opposed holding section is supported by the slide sustainment structure 42 at an end on the other side in the longitudinal direction of the drum in the present embodiment. As a result, deviance between rollers opposed to each other can be kept within a predetermined range (for example, 50 μm or less). Thus, the printer 1 by which an image having high accuracy can be formed is realized with a simple mechanism. The above-described predetermined range is decided in accordance with roller diameters, required precision and the like. Further, since a degree of freedom of design increases, it is possible to increase rigidity of the holding section 34 and the opposed holding section 36, and in addition, the apparatus is easily downsized.

Moreover, the slide sustainment structure 42 is positioned between the revolution sustainment structure 40 and the rotation axis 11S of the photoreceptor drum 11, when viewed from the direction of the rotation axis of the photoreceptor drum 11. Accordingly, even when a gear for transmitting driving force (see FIG. 13) receives extraordinary force, bending occurring in the holding section 34 or the opposed holding section 36 is small since the slide sustainment structure is positioned comparatively close to the gear G Hence, strength of the holding section 34 and the opposed holding section 36 constituting the process cartridge 3 may be reduced, whereby simplification of the process cartridge 3 can be achieved. Furthermore, since a configuration can be adopted in which the toner containment part 37 can be expanded up to a position over the rotation axis of the revolution sustainment structure 40 in the vicinity where the slide sustainment structure 42 is disposed, it is possible to increase a volume of the toner containment part 37. It is to be noted herein that a rotation direction of the gear G is counterclockwise in FIG. 13, while a direction of reaction force due to the gear G is in the direction shown as U in FIG. 13.

The longitudinal direction of the long hole 46 is not along the direction of the force received by the gear G As a result, deviance of the development roller 31 due to driving force can be reduced by a simple alignment configuration.

Further, since the slide sustainment structure 42 has a structure in which the opposed rollers are sustained by means of the long hole 46 and the projection 48 to be inserted into the long hole 46 in a slidable manner, the slide sustainment structure 42 can be made to be more simple.

Although the invention has been described above by referring to the embodiment, the embodiment is a mere example, and it may be variously modified without departing from the subject of the invention. As a matter of course, the scope of the invention is not restricted to the above-described embodiment. Particularly, it is to be noted that the following aspects are applicable, in addition to the first aspect of the invention.

A second aspect of the invention provides a position adjusting mechanism according to the first aspect, wherein the slide sustainment structure is provided on a driving side of the rollers.

As described above, when the driving side is sustained at two or more positions by the slide sustainment structures, deviance between the rollers and the opposed member can be reduced, even when the opposed member receives force while the rollers are driven.

A third aspect of the invention provides a position adjusting mechanism according to the first aspect, wherein the slide sustainment structure is positioned between the revolution sustainment structure and the rotation axis of the rollers, when viewed from a direction of the rotation axis of the rollers.

As a result, even when the opposed member receives extraordinary force while the rollers are driven, deviance between the rollers and the opposed member may be reduced since the slide sustainment structure is positioned in the vicinity of the opposed member.

A fourth aspect of the invention provides a position adjusting mechanism according to the first aspect, wherein the opposed member is opposed rollers disposed in the same direction as that of the rollers.

When the above-described slide sustainment structure is provided, although assurance of precision becomes difficult from a geometrical point of view, an error between shafts of the rollers and the opposed rollers is slight. Therefore, the rollers and the opposed rollers are maintained in parallel to each other, and the error thereof is within an allowable range.

According to the fourth aspect, deviance between the rollers and the opposed rollers that are opposed to the former rollers may be kept to be within a predetermined range.

A fifth aspect of the invention provides a position adjusting mechanism according to the first aspect, wherein the slide sustainment structure sustains the opposed holding section in a slidable manner, including: a long hole formed in one of the holding section or the opposed holding section; and a projection to be inserted into the long hole and provided on the other of the holding section or the opposed holding section.

The above-described long hole may also include a planiform hole and a circular arc hole. The long hole may be a throughhole or pouched. Moreover, a plurality of both of the long holes and the projections may be provided. Further, a section of the projection may be elongated, and further the projection may be arranged such that an elongated long hole (concave position) along the projection is formed in the projection, and a cap to be engaged with the long hole or the like is provided.

According to the fifth aspect, the slide sustainment structure may be simplified.

A sixth aspect of the invention provides a position adjusting mechanism according to the fifth aspect, wherein the projection abuts a guide surface of the long hole at two or more positions.

As a result, the opposed rollers can be sustained at two or more positions, even if there is only one long hole, so that the slide sustainment structure may be more simplified, whereby it contributes to space-saving.

A seventh aspect of the invention provides a position adjusting mechanism of one of the fifth aspect and the sixth aspect, wherein the longitudinal direction of the long hole is not along a direction of force received by the opposed holding section while the rollers are driven.

As a result, for example, when a force received by the opposed member while the rollers rotate acts in a direction in which the opposed member draws away, movement towards a direction in which the opposed holding section sustained by the slide sustainment structure draws away, in other words, movement towards a direction in which the opposed member draws away can be reduced with a simple alignment configuration. In addition, even when force acts in a direction in which the opposed member is pushed against the rollers, excessive force can be prevented from being applied to the rollers.

An eighth aspect of the invention provides a process cartridge including the position adjusting mechanism of the first aspect.

Thus, a process cartridge by which deviance between the rollers and the opposed member which is opposed to the rollers can be suppressed to within a predetermined range is realized.

A ninth aspect of the invention provides a process cartridge according to the eighth aspect, wherein the rollers are photoreceptor drums, and the opposed member comprises development rollers.

As a result, since there is little bending produced in the holding section and the opposed holding section, a cartridge with a simplified holding section and opposed holding section can be obtained. Furthermore, a layout of the slide sustainment structure may be comparatively free, so that a toner containment part can be expanded up to a position over a rotation axis of the revolution sustainment structure, thereby enabling an increase in a volume of the toner containment part.

The same advantageous effects can be attained as well when the above-described rollers are transfer rollers and the above-described opposed rollers are cleaning rollers which move into contact with the transfer rollers and move away therefrom.

A tenth aspect of the invention provides an image forming apparatus, including the process cartridge of one of the eighth aspect and the ninth aspect.

Thus, an image forming apparatus provided with a process cartridge with a simplified constitution and an increased volume of the toner containment part is realized.

What is claimed is:

1. A position adjusting mechanism, straddling a holding section for rotatably holding rollers and an opposed holding section for holding an opposed member disposed opposite to the rollers, wherein mutual positions between the holding section and the opposed holding section are adjusted, whereby mutual positions between the rollers and the opposed member are adjusted, the position adjusting mechanism comprising:

a revolution sustainment structure provided at an end on one side in the longitudinal direction of the rollers and rotatably sustaining the opposed holding section with respect to the holding section; and a slide sustainment structure sustained at another end on the other side in the longitudinal direction of the rollers at two or more positions and sustaining the opposed holding section with respect to the holding section in a slidable manner.

2. The position adjusting mechanism of claim 1, wherein the slide sustainment structure is provided on a driving side of the rollers.

3. The position adjusting mechanism of claim 1, wherein the slide sustainment structure is positioned between the revolution sustainment structure and a rotation axis of the rollers, when viewed from a direction of the rotation axis of the rollers.

4. The position adjusting mechanism of claim 1, wherein the opposed member is opposed rollers disposed in the same direction as that of the rollers.

5. The position adjusting mechanism of claim 1, wherein the slide sustainment structure sustains the opposed holding section in a slidable manner, comprising:

a long hole formed in one of the holding section or the opposed holding section; and a projection to be inserted into the long hole and provided on the other of the holding section or the opposed holding section.

6. The position adjusting mechanism of claim 5, wherein the projection abuts a guide surface of the long hole at two or more positions.

7. The position adjusting mechanism of claim 6, wherein a longitudinal direction of the long hole is not along a direction of force received by the opposed holding section while the rollers are driven.

8. The position adjusting mechanism of claim 5, wherein a longitudinal direction of the long hole is not along a direction of force received by the opposed holding section while the rollers are driven.

9. The position adjusting mechanism of claim 5, further comprising a cap attached to the slide sustainment structure so as not to disengage the holding section with the opposed holding section, wherein the projection is provided on the cap.

10. A process cartridge comprising the position adjusting mechanism of claim 1.

11. The process cartridge of claim 10, wherein the rollers are photoreceptor drums, and the opposed member comprises development rollers.

12. An image forming apparatus, comprising the process cartridge of claim 11.

13. An image forming apparatus, comprising the process cartridge of claim 10.

14. The image forming apparatus of claim 13, further comprising a cap attached to the slide sustainment structure so as not to disengage the holding section with the opposed holding section, wherein a projection is provided on the cap.

15. The process cartridge of claim 10, further comprising a cap attached to the slide sustainment structure so as not to disengage the holding section with the opposed holding section, wherein a projection is provided on the cap.

16. The image forming apparatus of claim 1, wherein said revolution sustainment structure is disposed on a rotation axis of an input gear receiving drive force from a main body of said image forming apparatus.

* * * * *